US005437074A

United States Patent [19]

White et al.

[11] Patent Number: 5,437,074

[45] Date of Patent: Aug. 1, 1995

[54] CAULKING TOOL

[75] Inventors: William White; Julie White, both of Indian Harbor Beach, Fla.

[73] Assignee: Myro, Inc., Milwaukee, Wis.

[21] Appl. No.: 280,045

[22] Filed: Jul. 25, 1994

[51] Int. Cl.[6] ..... A47L 13/02

[52] U.S. Cl. ..... 15/105; 15/236.01; 15/236.05; 15/245.1; D8/19; D8/45; D32/46

[58] Field of Search ..... 15/105, 105.5, 235.3, 15/236.01, 236.05, 236.06, 236.07, 236.08, 236.09, 245.1; 425/458; D3/208, 210, 211; D7/688; D8/16, 19, 45; D32/40, 42, 46, 47, 49

[56] References Cited

U.S. PATENT DOCUMENTS

| | | | |
|---|---|---|---|
| D. 27,254 | 6/1897 | Barden et al. | D32/49 |
| D. 28,738 | 5/1898 | Hamlin | D8/105 |
| D. 34,272 | 3/1901 | Hoffman | D32/46 |
| D. 46,890 | 1/1915 | Stimecz | D8/19 |
| 135,333 | 1/1873 | Haight | 15/236.05 |
| D. 138,750 | 9/1944 | Swenson | D8/16 |
| D. 141,123 | 5/1945 | Neiser | D7/688 |
| D. 265,940 | 8/1982 | Olsson | D32/46 |
| D. 293,072 | 12/1987 | Cook | D7/688 |
| D. 332,901 | 2/1993 | Campbell | D8/45 |
| 912,028 | 2/1909 | Prout | 425/458 |
| 1,211,098 | 1/1917 | Darrin . | |
| 2,824,323 | 2/1958 | Tos et al. | 15/105 |
| 2,900,656 | 8/1959 | Tupper | 15/105 |
| 3,046,670 | 7/1962 | Wydra | D8/19 |
| 3,080,593 | 3/1963 | Wilson | 15/105 |
| 4,698,870 | 10/1987 | Clark | 15/105.5 |
| 5,075,916 | 12/1991 | Englehart | 15/245.1 |
| 5,239,725 | 8/1993 | White | 15/105.5 |

*Primary Examiner*—Mark Spisich

[57] ABSTRACT

A caulking tool is formed of a flat plate with first and second major surfaces and an edge surface. The tool has a rectangular section with two rounded corners, an intermediate section abutting the rectangular section, and first and second projections extending from the intermediate section. The first projection tapers to a straight tip and the second projection tapers in a curved manner to another tip that points at substantially a right angle away from the straight tip. At both projections, edges of the second surface extend beyond edges of the first major surface with the edge surface convex from the edge of the first major surface to the edge of the second major surface.

11 Claims, 2 Drawing Sheets

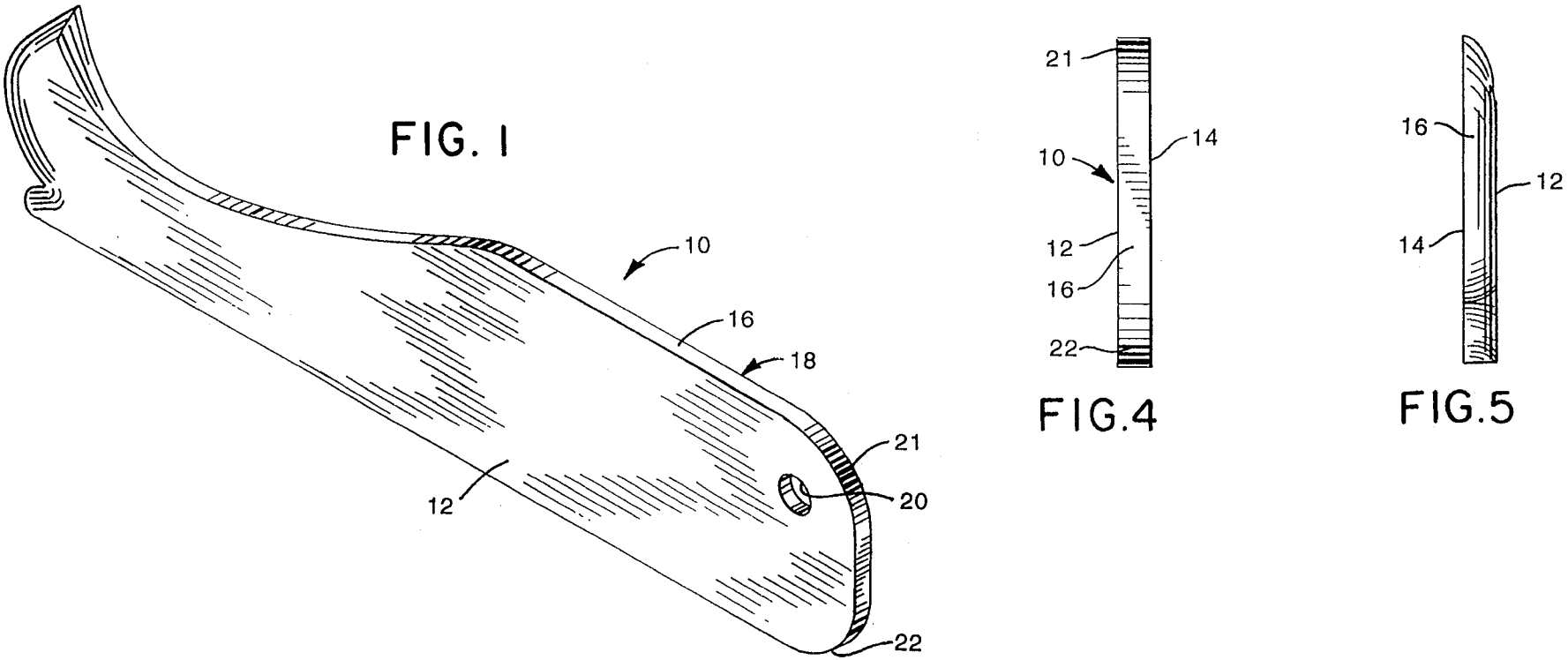
FIG. 5
FIG. 4
FIG. 1
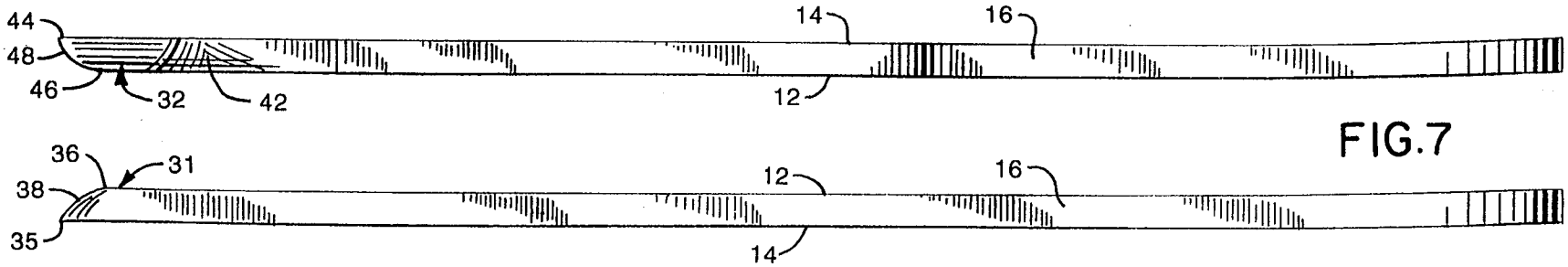
FIG. 6
FIG. 7

CAULKING TOOL

BACKGROUND OF THE INVENTION

The present invention relates to tools for removing caulk at sealed joints between two abutting surfaces.

Caulk is typically used to seal seams between a window frame and the exterior wall of a house to prevent air and water infiltration into that seam. Other types of caulking material are used to seal the joint between a bathtub and the surrounding wall to prevent water from entering the wall. Conventional caulking materials have a finite useful life and have a natural tendency to crack or peel at the end of that life. This not only provides a very unsightly appearance to the joint, but it also causes failure of the seal allowing moisture and air to infiltrate. Eventually even the best caulk has to be removed and new caulking material applied to the joint.

Removal of the failed caulking material is extremely difficult. A multiple step process has to be followed in order that the old material is satisfactorily removed to ensure that the new material will properly adhere to the joint. The first step is to get under a portion of the old caulk. Then the old caulk is lifted out of the seam while attempting not to strip, crack or separate the compound as this necessitates the need to start the removal process over. Once the majority of the material has been removed, it is necessary to scrape the surface to ensure complete removal of any residue left by the old compound. Usually, metal tools, such as a putty knife with relatively sharp straight edges, are employed in the caulk removal. Many of the tools commonly used to remove caulk will scratch, dent or deface the surfaces on the sides of the joint.

When the new caulking material is applied to the joint, it may be necessary to smooth and press the bead of caulk into the joint to assure that the bead adheres to joint surfaces. Typically, the joint is between two surfaces at right angles to one another making it difficult to smooth the caulk bead. As a consequence, an installer often uses a finger to smooth and press the caulk into place. However, because the caulk is highly adhesive, the caulk tends to build up on the user's finger from which it is very difficult to remove.

In many instances, the user has climbed a ladder in order to reach the seam where the caulk is to be removed and replaced. In such cases, it is disadvantageous for the installer to carry a number of tools in addition to the caulking gun or tube. Therefore, it is desirable to minimize the number of objects that the installer must carry up and down the ladder.

SUMMARY OF THE INVENTION

An object of the present invention is to provide a tool that can dig into existing caulk and rip it away from the surfaces to which it has been applied. Such ripping is performed by moving a pointed blade of the tool under the compound to release it from the surfaces.

Another object is to provide a caulk removal tool with a blade such that as the material releases from the surface to which it was attached, the blade pushes the material aside. This pushing action causes it to curl in a manner similar to earth being plowed in a furrow. The user can easily grasp the curled caulk and discard the old material.

A further object of the invention is to form the tool of a material that when used, will minimize scratching and damage to the surface below the caulk being removed.

Yet another object is to provide a curved point on the tool allowing that point to dig out caulking material deep within corner areas and provide a radius of that curved portion which allows it to reach into the corner without crowding the user's hand or the tool.

These objects are fulfilled by a caulking tool which comprises a handle portion and a blade attached to the handle portion. The handle portion is adapted to fit a user's hand. The blade, which preferably is flat, has first and second major surfaces with an edge surface extending around the blade between the first and second major surfaces. A section of the blade forms a straight projection which tapers in width. Along one side of the straight projection, a first edge of the second major surface extends outward beyond a second edge of the first major surface with the edge surface being curved from the first edge to the second edge. Another section of the blade forms a curved projection which tapers to a point. A third edge of the second major surface extends outward beyond a fourth edge of the first major surface along one side of the curved projection with the edge surface being curved from the third edge to the fourth edge.

In one embodiment of the caulking tool, the handle is flat and has a generally rectangular shape with two corners that are rounded at different radii. The rounded corners can be used to smooth a newly installed bead of caulking material with the user selecting which corner to use depending upon the amount of caulk that is desired to remain in the joint being sealed.

BRIEF DESCRIPTION OF THE DRAWINGS

FIG. 1 is an isometric view of a caulking tool according to the present invention;

FIGS. 4 and 5 are plane views of opposite end edges of the caulking tool;

FIG. 6 is a top plane view of the edge of the caulking tool; and

FIG. 7 is a plane view of the bottom edge.

DESCRIPTION OF THE PREFERRED EMBODIMENT

With reference to the drawings, a caulking tool 10 is formed by a flat plate of sheet material, such as plastic. The tool has opposite, parallel first and second major surfaces 12 and 14 with an edge surface 16 extending around the caulking tool between major surfaces 12 and 14.

Figure 2:
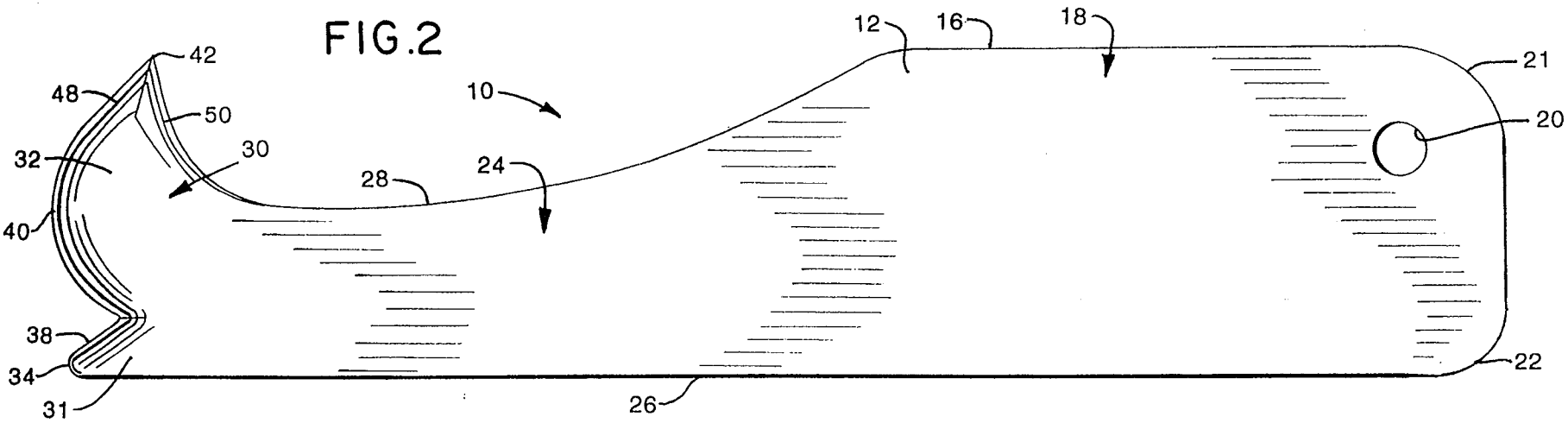
FIG. 2 is a plane view of a first major surface of the caulking tool.
Figure 3:
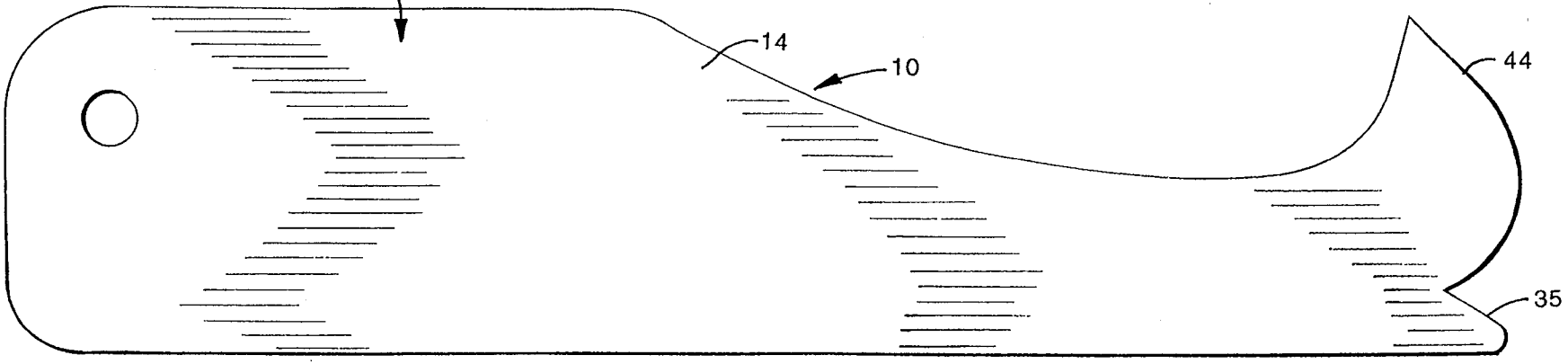
FIG. 3 is a plane view of a second major surface.

The caulking tool 10 has a rectangular portion 18 at one end with the rectangular portion being formed by straight sections of the edge surface 16 which are at orthogonal angles to each other. Two corners 21 and 22 of the rectangular section 18 are rounded. As shown particularly in FIG. 2, the radius of curvature of the upper corner 21 may be greater than the radius of curvature for the lower corner 22. The corners 21 and 22 can be employed by the user of the caulking tool 10 to smooth a bead of caulk that has been placed in a joint that is being sealed. The different radii of the two corners 21 and 22 provide different curvatures to smooth the caulk bead with the selection depending upon the amount of caulk which the user desires to remain in the joint. The rectangular section 18 also has an aperture 20 extending therethrough which is used to hang the caulking tool on a nail or hook for storage when the tool is not in use.

The caulking tool 10 also has an intermediate section 24 that extends from the rectangular section 18. One portion 26 of the edge surface 16 is straight extending along both the rectangular section 18 and the intermediate section 24. The opposite portion 28 of the edge surface along the intermediate section curves inward so as to narrow the width of the tool and provide a depression for grasping the tool.

At the end of the intermediate section 24 that is remote from the rectangular section 18 is a blade section 30 formed by first and second projections 31 and 32. The first projection 31 is a continuation of the straight edge portion 26 and is a straight projection that tapers to terminate in a tip 34 which is aligned with the intermediate and rectangular sections 24 and 18, respectively. Preferably, the tip 34 is rounded to avoid gouging a surface when tip is used to remove caulk from the surface. As shown in FIG. 7, the second major surface 14 has an edge 35 that projects outward from interior of the tool beyond edge 36 of the first major surface 12 along one side 38 of the first projection 31. The edge surface 16 along side 38 is convex going from edge 35 to edge 36, as shown at area 38 in the drawing. The other side of the first projection is flat being formed by a section of the straight edge portion 26 as shown in FIGS. 1 and 5.

The second projection 32 curves away from the first projection 31 forming a curved section 40 along the edge surface 16. The second projection 32 tapers to a second tip 42 which is pointed at substantially a right angle to the direction to which the first tip 34 points. Thus, the second curving projection 32 has a hook-like appearance which is useful in removing well-secured caulk, as will be described. With particular reference to FIG. 6, the second major surface 14 has an edge 44 that extends along both sides of the second projection 32 beyond the edge 46 of the first major surface 12. The portions 48 and 50 of the edge surface 16 between edges 44 and 46 on both sides of the second projection 32 also are convex going from edge 44 to edge 46.

When using the caulking tool 10 to remove previously applied caulk, the user grasps the tool about the rectangular section 18 by wrapping forefingers around the lower edge 26 and placing a thumb on the curved edge 28 of the intermediate section 24, for example. Thus the rectangular and intermediate sections act as a handle. Grasping the tool in this manner allows the user to push the pointed tip 34 of the first projection 31 into the caulk. This penetrating motion not only pierces the caulk, but by continuing to press the tip 34 along the installed bead of caulk, the forward motion of the tool removes any loose material. The convex edge surface 38 enables the first projection 31 to function as a plow forcing the caulk away from the joint and curling the caulk away from the joint surface much as earth being plowed into a furrow.

The curved second projection 32 is useful in removing any caulk that is held securely in place. In this case, the user flips the tool over in his hand wrapping forefingers around the rectangular section 18. In doing so a forefinger is placed around the portion of the curved edge 28 and a thumb is placed against the straight edge section 26. This enables the user to guide the sharp tip 42 into the previously opened caulk, and pull or push the tool so that the tip moves through the old caulk. The curved second projection 32 hooks under the caulk and pulls it out of contact with the surface to which it is adhered. The convex edge surfaces 48 and 50 cause the tip 42 to act as a plow forcing and curling the caulk away from the joint surface. This action forces the caulk away from the surface to which it had adhered. This pulling action allows the user to exert more force to plow through and pull out the remaining caulk.

Any residue on the surface can easily be removed by scraping the surface with the curved edge 40 of the second projection 32. Being made of a plastic, the tool 10 is unlikely to scratch the surface from which the caulk is being removed.

The key feature of the present caulking tool 10 is the plowing action created by each projection 31 and 32. Such action results in part from the convex edge surfaces 38, 48 and 50 of these projections. The removal process loosens the caulk and curls it out of the seam allowing the user to freely remove and discard the waste.

We claim:

1. A tool for removing caulk which tool comprises:

a handle portion for being grasped by a user's hand; and a blade attached to an end of said handle portion and having first and second major surfaces and an edge surface extending between the first and second major surfaces, said blade having a straight projection having a substantially straight first side, and straight projection tapers to a first tip with a first edge formed along a second side of the straight projection where the first major surface intersects the edge surface and a second edge formed along the a second side of the straight projection where the second major surface intersects the edge surface wherein the second edge lies outward beyond the first edge with the edge surface being curved from the first edge the first and second sides of the straight projection defining an acute angle therebetween, to the second edge, and said blade also having a curved projection defined by first and second curved sides which extend in a direction substantially transverse to the straight projection, said curved projection tapers to a point with a third edge formed along the first curved side of the curved projection where the first major surface intersects the edge surface and a fourth edge formed along the first curved side of the curved projection where the second major surface intersects the edge surface wherein the fourth edge lies outward beyond the third edge with the edge surface being curved from the third edge to the fourth edge.

2. The tool for removing caulk as recited in claim 1 wherein the edge surface along the straight projection is convex between the first and second edges.

3. The tool for removing caulk as recited in claim 1 wherein the edge surface along the curved projection is convex between the third and fourth edges.

4. A caulking tool comprising an elongated substantially flat plate having opposite first and second major surfaces with an edge surface extending between the first and second major surfaces and around the periphery of said plate;

a first end portion of said plate being substantially rectangular and defining a handle for manipulating the tool;

a second end portion of said plate including a substantially straight projection tapering to a first tip and a curved projection extending in the direction away from the first projection and tapering to a second tip, wherein along one side of the straight projection a first intersection of the second major surface with the edge surface lies outward beyond a second intersection of the first major surface with the edge surface, and the edge surface is curved from the first major surface to the second major surface along the one side of the straight projection, and wherein along two sides of the curved projection a third intersection of the second major surface with the edge surface lies outward beyond a fourth intersection of the first major surface with the edge surface, and the edge surface is curved from the first major surface to the second major surface along the two sides of the curved projection; and an intermediate portion of the plate located between the first end portion and second end portion, wherein the plate has a width that is smaller in the intermediate portion than in the first end portion.

5. The caulking tool as recited in claim 4 wherein the edge surface along the straight projection is convex.

6. The caulking tool as recited in claim 4 wherein the edge surface along the one side of the straight projection is convex.

7. The caulking tool as recited in claim 4 wherein the edge surface along the second projection is convex.

8. The caulking tool as recited in claim 4 wherein the edge surface along the two sides of the second projection is convex.

9. The caulking tool as recited in claim 4 wherein the rectangular section has two rounded corners.

10. The caulking tool as recited in claim 4 wherein the rectangular section has two rounded corners of different radii.

11. A caulking tool comprising an elongated substantially flat plate having opposite and substantially first and second parallel major surfaces with an edge surface extending between the two major surfaces and around the periphery of said plate;

a first end portion of said plate being rectangular and including two rounded corners, said rectangular end portion defining a handle for manipulating the tool;

a second end portion of said plate including a substantially straight projection tapering to a first tip aligned with a lower surface thereof, a curved projection extending in a direction substantially ninety degrees away from the first projection and tapering to a second tip at an upper surface thereof, the edge surface adjacent one side of the first projection being outwardly curved from the first to the second major surface, the edge surface adjacent both sides of the second projection being outwardly curved from the first to the second major surface; and an intermediate portion of the plate located between the first end portion and second end portion, wherein a dimension from the upper to the lower surface is smaller in the intermediate portion than in the first end portion.

* * * * *

UNITED STATES PATENT AND TRADEMARK OFFICE

CERTIFICATE OF CORRECTION

PATENT NO. : 5,437,074

DATED : August 1, 1995

INVENTOR(S) : William White, et al.

It is certified that error appears in the above-indentified patent and that said Letters Patent is hereby corrected as shown below:

In column 4, line 30, change "and" to --said--.

In column 4, line 39, after "first edge" insert --to the second edge,--.

In column 4, line 42, delete "to the second edge,".

Signed and Sealed this

Tenth Day of October, 1995

Bruce Lehman

*Attest:*

BRUCE LEHMAN

*Attesting Officer*

*Commissioner of Patents and Trademarks*